United States Patent [19]

Wacksman

[11] Patent Number: 4,553,916

[45] Date of Patent: Nov. 19, 1985

[54] ROTARY FORCE FLUID PUMP

[75] Inventor: David Wacksman, West Palm Beach, Fla.

[73] Assignee: Katherine R. Smith, Boynton Beach, Fla.

[21] Appl. No.: 639,101

[22] Filed: Aug. 9, 1984

[51] Int. Cl.[4] ..... F04C 2/352

[52] U.S. Cl. ..... 418/173; 418/253

[58] Field of Search ..... 418/172, 173, 174, 176, 418/177, 253, 256

[56] References Cited

U.S. PATENT DOCUMENTS

| | | | |
|---|---|---|---|
| 1,712,935 | 5/1929 | Seaholm | 418/173 |
| 1,806,206 | 5/1931 | Lees | 418/173 |
| 2,184,753 | 12/1939 | Palmer | 418/173 X |
| 2,705,591 | 4/1955 | Anderson | 418/173 |

*Primary Examiner*—Leonard E. Smith

*Attorney, Agent, or Firm*—Steele, Gould & Fried

[57] ABSTRACT

A rotary fluid pump, comprising: a housing defining a circular cylindrical pumping chamber; at least one blade positioning ring mounted for rotation around the periphery of the pumping chamber; an eccentrically disposed drive shaft for slidably engaging and rotating a blade mechanism in the pumping chamber; means enabling the blade mechanism to rotatably drive the at least one blade positioning ring and accommodate the eccentric rotation of the blade; and, fluid intake and exhaust ports. A first embodiment further comprises: a stacked pair of blade positioning rings mounted for independent rotation around the periphery of the pumping chamber; a blade assembly pivotably mounted at each end to a different one of the rings; and, slidably interfitting structure in the blade assembly for accommodating the relative movement of the ends of the blade assembly during the eccentric rotation. A second embodiment comprises structure effecting sequential engagement and disengagement of the blade to preselected positions on the ring during rotation, which together with the sliding movement between the blade and the drive shaft, changes the effective length of the blade during the eccentric rotation.

14 Claims, 21 Drawing Figures

ROTARY FORCE FLUID PUMP

BACKGROUND OF THE INVENTION

1. Field of the Invention

This invention relates to the field of fluid pumps in general, and in particular, to a rotary input positive displacement pump having an off-axis drive shaft and accompanying eccentric structural operation.

Rotary driven fluid pumps have been disclosed, for example, in the following U.S. Pat. Nos. 219,365; 1,806,206; 2,316,318; 3,894,819; 3,288,119; 3,551,080; 3,299,822; 3,671,153; 3,387,772; 3,716,314; 4,150,926; and 4,278,409. A rotary driven fluid pump is also disclosed in British Pat. No. 13,070 (of 1884). Typically, the fluid pumps described in the foregoing references have a number of significant shortcomings. The seals between the stationary housing and the rotating member wear out very quickly. Flexible vane pumps are incapable of producing high pressure. Although gear-type pumps are capable of producing high pressure, they tend to be relatively low volume devices.

A first significant improvement over such prior art rotary pumps is disclosed in my U.S. Pat. No. 4,431,391. A high-volume positive displacement pump has a rotationally driven blade which creates a pressure differential, and therefore a fluid flow within a circular pump case cavity split by the blade. As the blade is rotatably driven about an axis which is non-aligned with the center of the circular case, the unique geometry provides high fluid flow characteristics. A unique sealing means was provided between the ends of the rotating blade and the cavity ring portion of the circular case in the form of concentric rings within the case. More particularly, the ends of the rotating blade were sealed relative to the inner circular wall of the stationary casing by a partial inner and outer mating pair of concentric circular rings, matingly seated for rotation within the casing and driven by the inter-connecting ends of the blade. One end of the blade is pivotably locked to the partial ring while the other end of the blade is pivotally and slidably held by an intermediate knuckle in the outer ring. A sliding movement occurs between the knuckle and the mating end of the blade to accommodate the off-center rotational geometry of the rotating blade.

Although the pump disclosed in my earlier patent was most effective, a result of using concentric circular rings is that the volume of the pumping cavity available for pumping is reduced in volume, at least by the volume of the inner partial concentric ring.

In order to develop a rotary force positive displacement pump which could take advantage of the unique geometry of my earlier pump, but which at the same time had the advantage of increased pumping volume capacity, it was necessary to develop new blade sealing and mounting systems. Generally speaking, a rotary force fluid pump according to the new blade sealing and mounting systems comprises: a housing defining a circular cylindrical pumping chamber; a blade means for moving fluid through the pumping chamber; at least one blade means positioning ring mounted for rotation around the periphery of the pumping chamber; eccentrically disposed drive means for slidably engaging and rotating the blade means in the pumping chamber; means enabling the blade means to rotatably drive the blade positioning ring and accommodate the eccentric rotation of the blade; and, fluid intake and exhaust ports. Accordingly, the pumps disclosed herein utilize an arrangement for positioning the blade, an arrangement for a blade assembly and a means for sealing the ends of the blade assembly which are entirely novel with respect to my earlier pump, but at the same time, preserve the unique and effective pumping geometry. In particular, and disposed in a similar housing defining a circular cylindrical pumping chamber, a first embodiment of the new pump includes a stacked pair of blade positioning rings mounted for independent rotation around the periphery of the pumping chamber. Instead of having concentric rings, one disposed inside the other, so as to reduce the volume of the pumping chamber, the rings of this pump are stacked one above the other, taking up no more room in the pumping chamber than the outer ring of the earlier pump.

The blade assembly of the new pump is pivotally mounted at each end to a different one of the rings, yet still divides the pumping chamber into two sections which vary in volume as the blade assembly rotates. Whereas the blade of the earlier pump was fixedly and pivotally mounted at one end, to the inner ring, and pivotally and slideably mounted at the other end to the outer ring, the blade assembly of the new pump is pivotally and fixedly mounted at each end to a different one of the stacked rings. In other words, one end of the blade assembly is pivotally and fixedly mounted to the upper ring, and the other end of the blade assembly is pivotally and fixedly mounted to the lower ring. In both pumps, eccentrically disposed drive means slidably engage and rotate the blade or blade assembly in the pumping chamber. In both instances, the blade in turn rotatably drives the two rings at different speeds relative to one another, causing the points of attachment of the blade or blade assembly to the rings to move toward and away from one another during rotation. The angular orientation of the lengthwise blade axis relative to each of the rings also changes, and changes differently, during rotation. The new pump includes means incorporated into the blade assembly for accommodating the relative movement of the pivotally and fixedly mounted ends of the blade assembly, and in particular, comprises two rigid parts with slidably interfitting structure.

Finally, the new pump utilizes resilient means disposed between the inner surfaces of the positioning rings and corresponding inner surface engaging structure of the blade assembly. The resilient sealing means include an elongated semi-cylindrical seal carried by each end of the blade assembly in a semi-circular notch which slidably receives each seal. The substantially flat surface of each seal slidably engages the inner surfaces of the positioning rings. The seals are free to rotate within the mounting structure of the blade assembly in order to accommodate the different angular orientations between the lengthwise blade axis and a tangent line of the ring at the point of pivotal attachment.

In a second embodiment, the new rotary force fluid pump comprises: a housing defining a circular cylindrical pumping chamber; a blade disposed in the pumping chamber; a blade positioning ring mounted for rotation around the periphery of the pumping chamber; eccentrically disposed drive means for slidably engaging and rotating the blade in the pumping chamber; means effecting sequential engagement and disengagement of the blade to preselected positions on the ring during rotation, which together with the sliding movement between the blade and the drive means, change the effective length of the blade during the eccentric rotation; and, fluid intake and exhaust ports.

Overall, the new pumps provide significant advantages in enhanced pumping capacity.

SUMMARY OF THE INVENTION

It is an object of this invention to provide an improved rotary fluid pump.

It is another object of this invention to provide an improved rotary fluid pump having a larger pumping capacity for a given pumping chamber.

It is still another object of this invention to provide a rotary fluid pump with improved pumping volume capacity which at the same time utilizes the unique pumping geometry of eccentrically mounted drive means.

These and other objects of this invention are accomplished by a rotary fluid pump, comprising in a first embodiment: a housing defining a circular cylindrical pumping chamber; a stacked pair of blade positioning rings mounted for independent rotation around the periphery of the pumping chamber; a blade assembly pivotally mounted at each end thereof to a different one of the rings and dividing the pumping chamber into two sections which vary in volume as the blade assembly rotates; eccentrically disposed drive means for slidably engaging and rotating the blade assembly in the pumping chamber, the blade in turn rotatably driving the rings at different speeds relative to one another, causing the pivotally mounted ends of the blade assembly to move toward and away from one another during rotation; means in the blade assembly for accommodating the relative movement of the ends of the blade assembly during the eccentric rotation; means for admitting fluid into the chamber; and, means for exhausting fluid from the chamber. In the presently preferred embodiment, the ends of the blade assembly are pivotally and fixedly mounted at each end to a different one of the rings, and the blade assembly comprises two rigid parts, each of the rigid parts being pivotally and fixedly mounted to a different one of the rings. Each of the rigid parts comprises slidably interfitting structure, the interfitting structure being disposed generally through the middle of the pumping chamber. The pump further comprises resilient sealing means disposed between the inner surfaces of the positioning rings and corresponding inner surface facing structure of the blade assembly. The sealing means are elongated resilient seals of semi-circular cross section. Each seal is carried by a semi-circular notch adjacent each end of the blade assembly. Each of the seals is slidably disposed in the notch, and able to rotate therein during rotation of the blade. The substantially flat surface of each seal engages the inner surfaces of the positioning rings. Due to the eccentric rotation of the blade assembly, the angle of the lengthwise axis of the blade assembly varies during rotation, relative to a tangent line of each ring at each fixed, pivotal point of attachment. Automatic rotation of the semi-circular seals enhances the fluid seal between the blade and rings and prevents self-destruction of the seals by accommodating the varying angular orientation. It is a particularly important aspect of this invention that a structural arrangement of blade assembly and rings prevents self-destruction of the seals during operation.

These and other objects of this invention are also accomplished by a rotary force fluid pump, comprising in a second embodiment: a housing defining a circular cylindrical pumping chamber; a blade disposed in the pumping chamber; a blade positioning ring mounted for rotation around the periphery of the pumping chamber; eccentrically disposed drive means for slidably engaging and rotating the blade in the pumping chamber; means effecting sequential engagement and disengagement of the blade to preselected positions on the ring during rotation, which together with the sliding movement between the blade and the drive means, change the effective length of the blade during the eccentric rotation; and, fluid intake and exhaust ports.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 2:
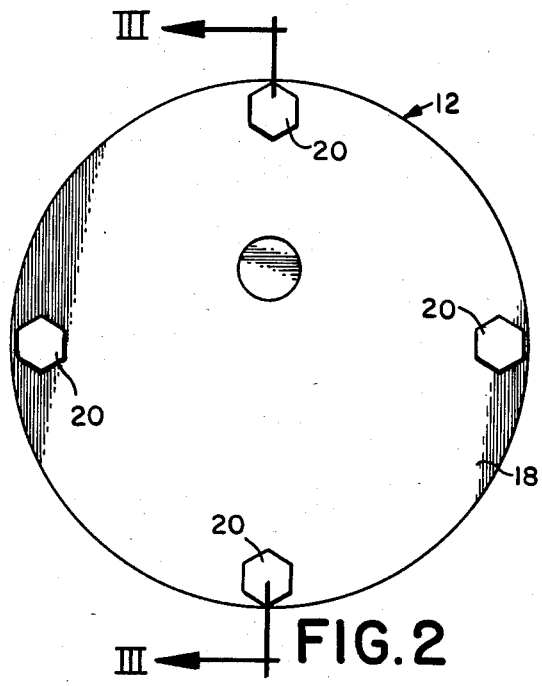
FIG. 2 is a top plan view of FIG. 1.

In describing the various features and modes of operation the embodiments of this invention disclosed herein, terms such as up, down, right, left, clockwise and counterclockwise will be used with respect to the orientation of the various figures which illustrate the invention. It will be appreciated by those skilled in the art that the rotary pumps according to this invention need not be disposed or mounted in any particular orientation in order to function properly. Such terms are used merely for purposes of convenience and should not be construed as limiting the scope of the invention.

A first embodiment 10 of a rotary fluid pump comprises a housing 12 having an annular wall 14, a bottom plate 16 and a top plate 18. In the embodiment illustrated, the bottom plate and annular wall are integrally formed, and the top plate is attachable thereto by means of bolts 20 which pass through the top plate 18 and engage in threaded bores 22 in annular wall 14. It will be appreciated that the top plate might be integrally formed with the annular wall, the bottom plate being the attachable member. It is also possible that both the top and bottom plates would be attachable to an annular wall. In any event, the housing 12 defines a cylindrical pumping chamber 24 of circular cross-section in plan. The circular cross section defines a central axis 26 of the pumping chamber 24. Upper plate 18 is provided with a bore 28 and lower plate 16 is provided with a correspondingly aligned bore 30. Lower plate 16 is also provided with an intake port 32 and an exhaust port 34.

The "piston" of the pump is a blade means or assembly 36. Blade means or assembly 36 is held in the pumping chamber 24 by first and second blade positioning rings 38 and 40. Blade positioning rings 38 and 40 are substantially identical to one another in size and shape, and are stacked one on top of the other. The blade positioning rings are mounted for independent rotation, relative to one another, around the periphery of the pumping chamber. The outer facing surfaces (relative to the pumping chamber axis 26) slidably engage the inner facing surfaces of the annular wall 14.

The blade means or assembly 36 comprises two rigid slidably interfitting parts. Blade part 42 is in the nature of a yoke, wherein rigid blades 41 and 43 extend in a first direction from end 45, defining a rectangular slot 47 therebetween. A mounting flange 44 extends from end 45 in the opposite direction. Blades 41, 43 and flange 44 lie in planes which are perpendicular to one another. Blade part 46 has a single blade 49 extending in a first direction from an end 51. The width and other dimensions of blades 41, 43 and 49, as well as slot 47, are dimensioned to enable blade 49 to be slidably and substantially sealably received in slot 47, thereby enabling the relative movement of blade parts 42 and 46 illustrated in FIGS. 4–9. Flange 48 extends from end 51 in a direction opposite to blade 49, and lies in a plane perpendicular to that defined by blade 49.

Figure 3:
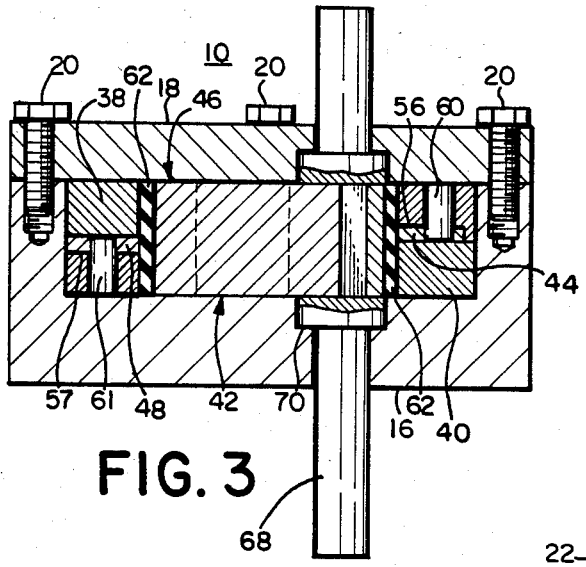
FIG. 3 is a section view taken along the line III—III in FIG. 2.
Figure 1:
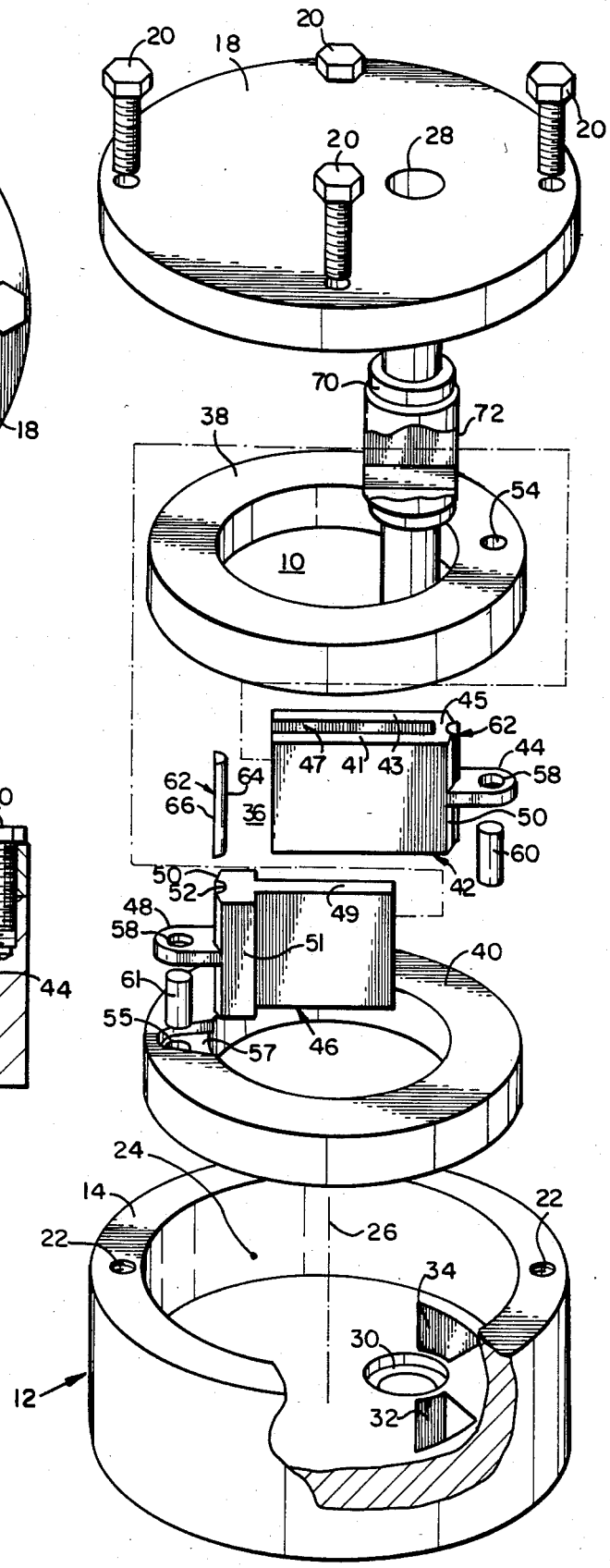
FIG. 1 is an exploded perspective view of a rotary fluid pump according to this invention.

Blade means or assembly 36 is pivotally and fixedly mounted at each end to a different one of the blade positioning rings 38 and 40. Rings 38 and 40 are provided with bores 54 and 55 respectively, parallel to pumping chamber axis 26. At one flat surface of each of blade positioning rings 38 and 40, substantially triangular recesses or open slots 56 and 57 respectively extend from and around bores 54 and 55 and open inwardly toward pumping chamber 24. With reference to FIG. 3 in particular, blade positioning rings 38 and 40 are so oriented that the recess or open slot 56 of upper ring 38 faces downwardly, that is, opening toward blade positioning ring 40. In an analogous fashion, the recess or open slot 57 of the lower blade positioning ring 40 opens upwardly, that is facing upper blade positioning ring 38. Although flanges 44 and 48 are disposed in planes which are parallel to one another, they are not disposed in the same plane. Stated otherwise, flange 44 fits into a recess in the bottom flat surface of upper ring 38, whereas flange 48 fits into a recess in the upper flat surface of blade positioning ring 40. Each of the flanges, and in turn each of the blade parts 42 and 46, are secured to a different one of the rings by pivot pins 60 and 61 which pass through bores 54 and 55 in the rings and bores 58 in the flanges. Pivot pins 60 and 61 extend for the full height of each of the rings. The triangular slots or open recesses 56 and 57 enable a pivoting movement of the blade means or assembly 36 relative to each of the rings during the movement illustrated in FIGS. 4–9.

Beveled faces 50 at the ends 45 and 51 of blade parts 42 and 46 respectively also provide clearance for such movement. Beveled faces 50 are in fact recessed slightly from or set back from the inner surfaces of the blade positioning rings. Each of the ends 45 and 51 of blade parts 42 and 46 respectively are also provided with notches 52 of substantially semi-circular cross-section. Due to the beveled faces 50, as well as the set back orientation thereof, the notches extend through an arc which is somewhat less than 180°. Each of the notches 52 is adapted to receive a resilient sealing member 62 of substantially semi-circular cross-section. The semi-circular surface 64 of each sealing member is adapted to slidably rest in the correspondingly shaped portion of notch 52. The substantially flat portion 66 of each sealing member is adapted to slidably engage the inner surfaces of the blade positioning rings during the rotation illustrated in FIGS. 4–9.

A drive means for the pump will act through a drive shaft 68 extending through bores 28 and 30, the pumping chamber being sealed by bushings or sealed bearings 70. A slotted drive section 72 of the shaft is disposed within the pumping chamber 54. The blade means or assembly 36 is slidably disposed within the slot of the drive section. As the drive shafts 68 rotates, it will cause the blade means or assembly 36 to rotate with it. At the same time, however, the slotted mounting arrangement will enable the blade assembly to translate or move perpendicularly relative to the axis of drive shaft 68.

Figure 4:
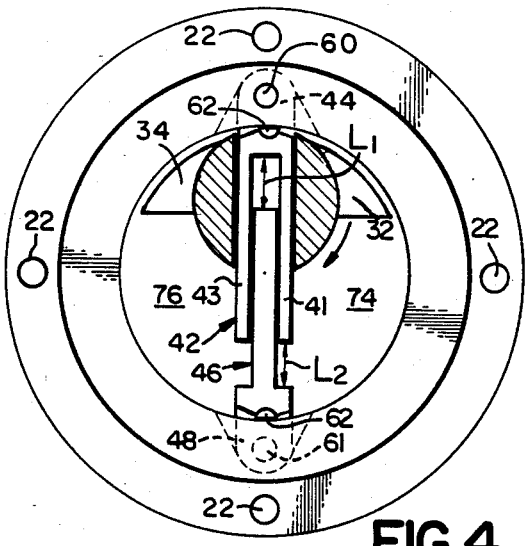
FIGS. 4–9 are plan views, partially in section and partially diagrammatic in nature, sequentially illustrating the operational geometry of the rotary fluid pump shown in FIG. 1, through a cycle of operation.

Operation of the rotary fluid pump 10 according to this invention can now be appreciated from the various operating positions sequentially illustrated in FIGS. 4–9. Certain conventions have been adopted for purposes of clarifying the explanation. For the most part, structural members are numbered only in FIG. 4. The undesignated arrow adjacent slotted drive section 72 indicates clockwise rotation throughout the illustrated sequence. Distance $L_1$, which includes a double headed arrow only in FIG. 4, indicates the distance between the free end of blade 51 and the inner end of slot 47 adjacent the end 45 of blade part 42. Distance $L_2$, represented by a double ended arrow only in FIG. 4, represents the distance between the free ends of blades 41 and 43 and the end 41 of blade part 46. Distances $L_1$ and $L_2$ will increase and decrease to the same extent during operation of the pump. With respect to the orientation of FIG. 4, blade means or assembly 36 divides the pumping chamber 34 into a first chamber section 74 and a second chamber section 76. The respective volumes of chamber section 74 and 76 will vary inversely during operation of the pump, although not in directly inverse proportion. Intake port 32 is connected externally to a fluid source. Exhaust port 34 is connected externally to a fluid discharge point or collection reservoir. Due to the operational geometry of the rotary pump, the intake and exhaust ports are preferably disposed adjacent the drive section 72 and on opposite sides thereof, although not diametrically opposite one another. The external connections do not form a part of this invention, and are not illustrated in the drawings.

In the orientation of FIG. 4 the blade means or assembly 36 divides the pumping chamber into sections of equal volume. The center of the blade means 36 is aligned with the central axis 26 of the pumping chamber. If the blade assembly 36 is thought to define a lengthwise axis, then such an axis would be perpendicular to a tangent line of each of the blade positioning rings 38 and 40, and running through pivot pins 60 and 61. As is apparent from FIGS. 5, 6, 7 and 9, this angle will constantly vary during operation of the pump.

As the drive section 72 rotates clockwise, the blade assembly 36 will be rotated clockwise. It is clear that the axis of the drive section 72 is disposed eccentrically, that is off-axis, with respect to the central axis 26 of the pumping chamber. Accordingly, the distance between the axis of drive section 72 and pivot pin 60 is considerably shorter than the distance between the axis of drive section 72 and pivot pin 61. Accordingly, for a given angle of rotation of the drive section 72, in a clockwise direction from the position shown in FIG. 4, pivot pin 61 will be moved through a longer circular arc than pivot pin 60 will be so moved. Therefore, for a given angle of rotation of drive section 72, lower blade positioning ring 40 will be rotated faster and further when upper blade positioning ring 38 will be rotated. Nevertheless, the ability of the blade positioning rings 38 and 40 to rotate independently of one another, despite providing fixed, pivotal mounting points for one end each of the blade assembly or means 36, fully accommodates the differential rotation of the points of attachement on the rings.

It can also been seen that in the position of FIG. 4, where the center of the blade assembly 36 coincides with axis 26 of the pumping chamber, pivot pins 60 and 61 are as far away from one another as is possible. At the same time, distances $L_1$ and $L_2$ are also as large as is possible.

Figure 5:
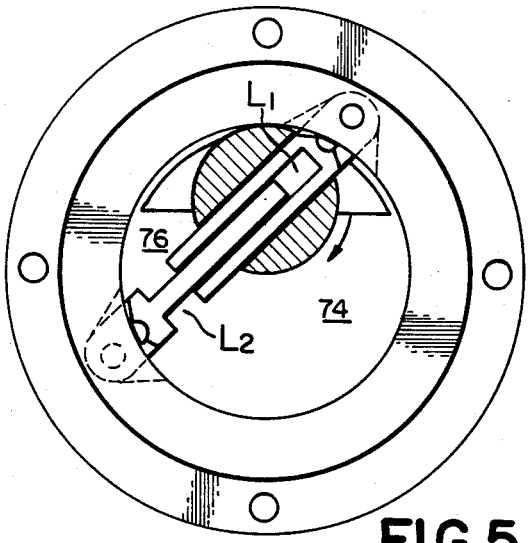

In FIG. 5, the drive shaft has rotated clockwise approximately 45°. During the course of this rotation pivot pin 61, and ring 40 with it, has moved a greater distance than pivot pin 60 and ring 38. The center of blade assembly 36 no longer coincides with the central axis 26 of the pumping chamber. Moreover, distances $L_1$ and $L_2$ have decreased, as pivot pins 60 and 61 have moved closer to one another. However, the slidably interfitting blades 41, 43 and 49 fully accommodate the change in length of the blade assembly which becomes necessary as the blade assembly is eccentrically rotated within the pumping chamber.

Figure 6:
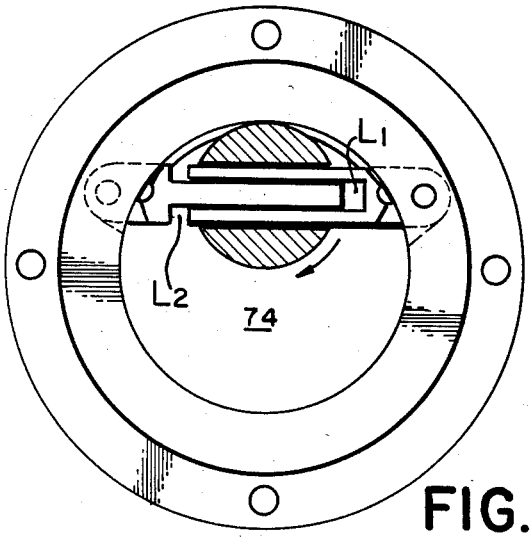

After a further 45° increment of rotation of the drive shaft, the blade assembly and blade positioning rings have reached the position shown in FIG. 6. In this orientation, pivot pins 60 and 61 are as close to one another as is possible, and distances $L_1$ and $L_2$ are as small as possible. Moreover, the angular orientation of the lengthwise blade axis relative to tangents as described above is also at its greatest extent.

Figure 7:
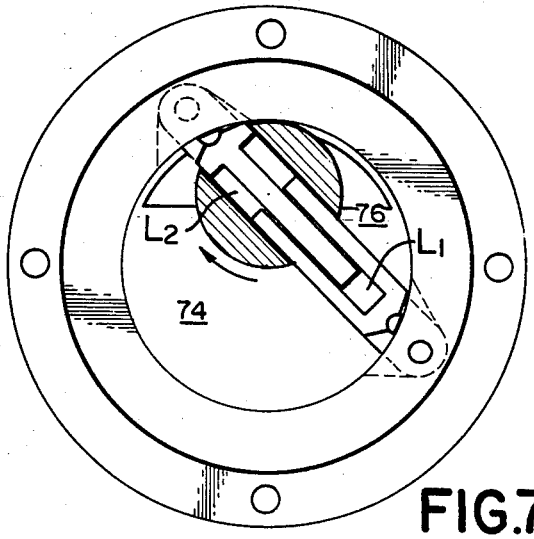

As the drive shaft and blade rotate through a further 45° increment, reaching the position shown in FIG. 7, pivot pins 60 and 61 move away from one another, increasing distances $L_1$ and $L_2$, and lengthening the blade assembly.

Figure 8:
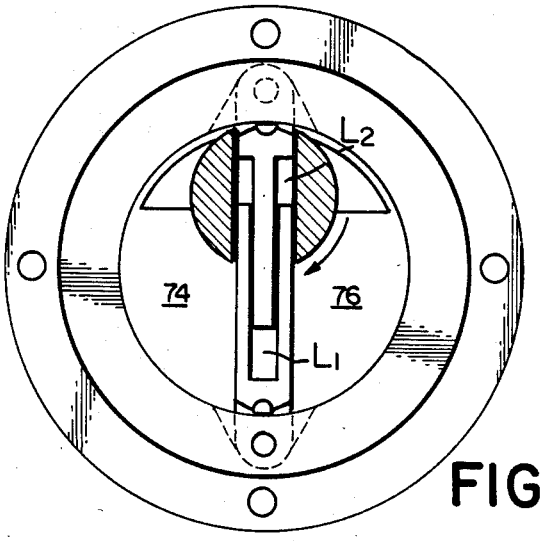
Figure 9:
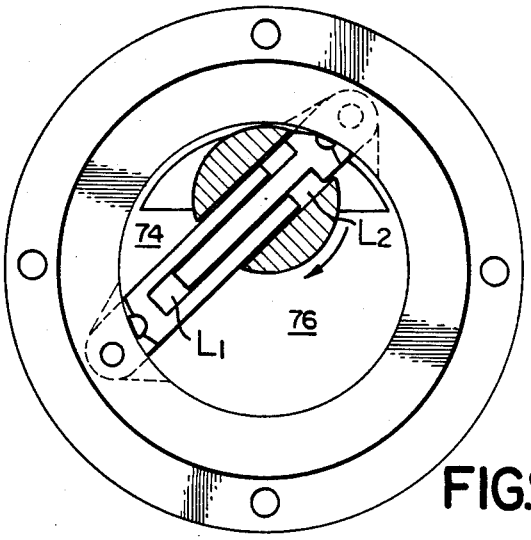

A still further 45° increment of rotation of the drive shaft and blade assembly will result in the orientation shown in FIG. 8. This orientation is functionally equivalent to that of FIG. 4, except that the positions of blade parts 42 and 46 and of pivot pins 60 and 61, have been reversed. This reversal of position does not alter operation of the pump, as can be appreciated from FIG. 9, which illustrates a still further 45° increment of rotation. The orientation of FIG. 9 is a functional equivalent to the structural orientation of FIG. 5, not withstanding the reversal of parts as in FIG. 8. Throughout the entire cycle of operation the blade assembly automatically changes in length during the eccentric rotation. Despite the eccentric rotation the freely and independently rotating blade positioning rings are able to positively position and guide the blade assembly despite the eccentric rotation. Positive guidance of the blade assembly is certain, despite the eccentric rotation, despite the automatic length adjustment of the blade assembly, despite the free standing and independent operation of the blade positioning rings and despite the varying angular orientation of the lengthwise blade axis relative to tangents of the rings at the pivot points. Pivotal movement of the seals in their mounting slots maintains operational pressure and prevents premature destruction of the seals. Moreover, the size of the pumping chamber has not at all been decreased by a mounting arrangement requiring an inner, concentric mounting ring.

The pumping function follows from the mechanical operation of the pump and the interaction of each of its components. Referring again to FIG. 4, assume that chamber sections 74 and 76 are each filled with fluid, for example water. As the blade assembly is rotated clockwise into the position of FIG. 5, fluid in chamber section 76 is forced out of exhaust port 34. At the same time, additional fluid is sucked or drawn into chamber section 74. Rotation to the position of FIG. 6 will substantially empty section 76, and will result in nearly the full capacity of the pumping chamber being filled with fluid in chamber section 74. Further rotation to the position of FIG. 7 will begin to force fluid from chamber section 74 out through the exhaust port 34. At the same time, chamber section 76 will begin to fill with fluid being sucked or drawn into intake port 32. Further rotation to the position of FIG. 8 shows that chamber sections 74 and 76 are each filled with fluid, as in FIG. 4, eccept that the positions of chamber sections 74 and 76 have been reversed. Further rotation to the position of FIG. 9 continues to empty chamber section 74 and continues to fill chamber section 76 as explained in connection with FIG. 5. The sequence continues. It can be seen that for each full rotation of the drive shaft, the rotary fluid pump will fill and empty its pumping chamber twice. Rotary fluid pumps according to this invention are extremely efficient.

A second embodiment 100 of a rotary fluid pump comprises a lower housing 112 and an upper housing 114 which are substantially identical to one another. The housings differ from one another only insofar as necessary to accommodate means for attaching the upper and lower housings to one another. Accordingly, the annular wall 116 of housing 112 is provided with a plurality of threaded bores 120 for receiving bolts 108, whereas annular wall 118 of upper housing 114 is provided with a plurality of corresponding through bores 122. Gasket rings and the like are omitted throughout the drawings for purposes of clarification.

Each of the housings 112 and 114 comprise a bottom plate defining an inner, flat circular surface 124 forming an inner wall of the pumping chamber. An annular slot 126 is formed in each surface 124, at the inside perimeter of the annular wall. Each slot 126 has as pair of further, deeper slots 128. A blade 140 is slidably mounted in a slot 142 of the driving hub 138. The driving hub 138 seats in an appropriately formed set of bores 130 which accommodate sealed bushings or sealed bearings (not shown) as utilized in the first embodiment. An arcuate stationary shaft seal section 136 is formed at the edge of each surface 134, conforming in shape on one side to the outer perimeter of a drive hub 138 on the drive shaft of the pump and the inside perimeter of slot 126 on the other side. The opposite ends 144 of the blade 140 are tapered, and are provided with curved tips, as viewed in plan. At the very end of the upper and lower surfaces of the blade, nested in the tapered portions thereof, are four circular or substantially hemispherical detents or indents 146. As the drive hub 138 is rotated, blade 140 will be rotated with it. During such rotation, blade 140 is free to move radially in the slot 142 in either direction.

A ring 162 is disposed in the annular slots 126, and is adapted to be rotatably driven therein by the blade 140. The ring is provided with three equiangularly spaced vertical slots 164 formed on its inside perimeter. The slots are substantially triangular in plan, each having a rounded apex. The shape and size of the slots 164 correspond generally to the shape of the ends 144 of the blade 140, although slots 164 are larger to provide some freedom of movement and rotation between the ring and the ends of the blade.

A swivel catch member 148 is permanently seated at the top and bottom of each of the slots 164, there being six such swivel catch members in all.

Each of the swivel catch members 148 comprises a larger substantially hemispherical portion 150, a substantially circular cylindrical body of smaller diameter than base 150 and a smaller substantially hemispherical portion 154. The substantially circular cylindrical portion 152 is not centered on base 150, but is disposed toward one edge thereof. At that edge the swivel catch has a vertical, flattened surface 156. Surface 156 may be flat, or may be formed with a slight concavity. Each of the swivel catches is identical. In view of the portion 150 being larger in diameter than portions 152 and 154, the very upper and lowermost parts of slots 164 are provided with enlarged portions 166 to accommodate portions 150. When the swivel catches 148 are disposed in the slots 164 of the ring 162, and the ring 162 is disposed in the annular slots 126 of the housings 112 and 114, the portions 150 of the swivel catches ride on, or engage raceways 127 formed by slots 126. The curvature of the hemispherical portions 154 of the swivel catches 148 correspond in size and shape to the circular indents 146 at the ends 144 of the blade 140.

Figure 17:
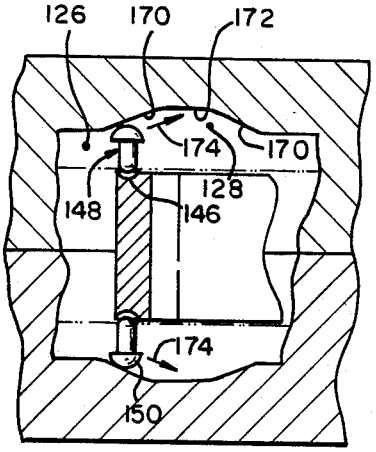
FIG. 17 is a section view taken along the line 17—17 in FIG. 11.
Figure 18:
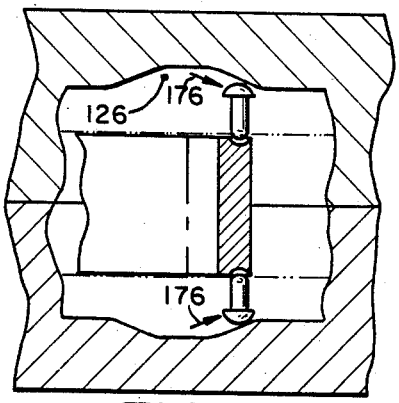
FIG. 18 is a section view taken along the line 18—18 in FIG. 11.
Figure 10:
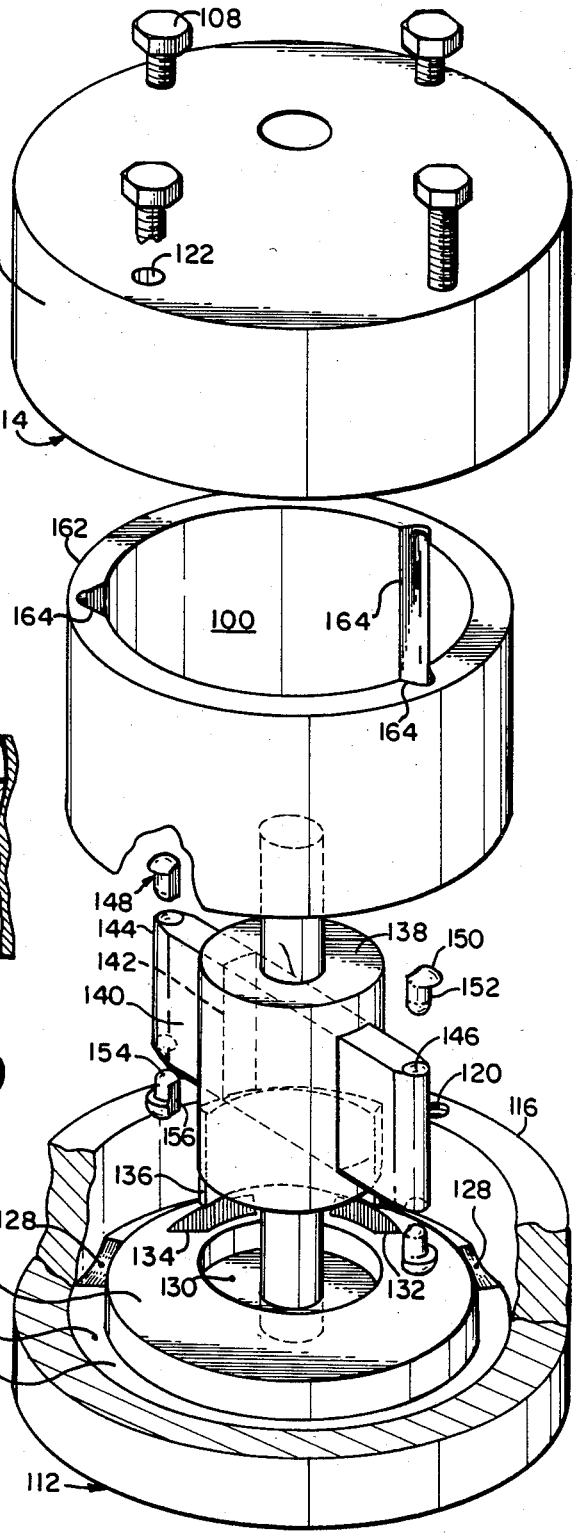
FIG. 10 is an exploded perspective view of an alternative embodiment of rotary fluid pump according to this invention.

During operation of the rotary fluid pump 100, the ends of the blade are adapted to move in and out of the slots 164 of ring 162, as the drive hub 138 rotatably drives blade 140, which in turn rotatably drives ring 164. When an end 144 of the blade 140 is to be disposed in one of the slots 164, to drive the ring 162, it is necessary to provide a positive engagement between the two, the positive engagement being provided by the swivel catches 148. The corresponding shapes of the indents 146 and the hemispherical top portions 154 provide a camming action which enables the swivel catches to move into and out of engagement with the blade as necessary, the swivel catches being always in engagement with the rings. The movement of the swivel catches into and out of engagement with the blade is accommodated by the slots 128. The shape and form of slots 128 can be seen most clearly in FIGS. 17 and 18. Each slot 128 has a substantially flat central portion 172 connected to the raceway of slot 126 by inclined ramp portions 170. The transition between portions 170 and 172 and between portions 170 and the raceway are slightly curved.

Figure 19:
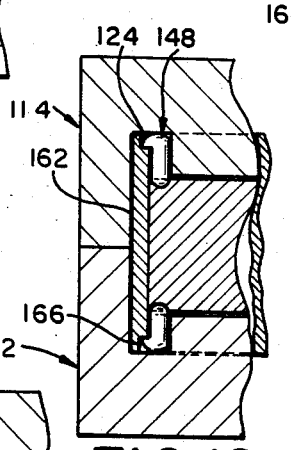
FIG. 19 is a section view taken along the line 19—19 in FIG. 13.
Figure 20:
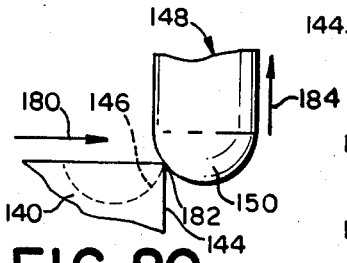
FIGS. 20 and 21 illustrate the camming action of the swivel catches in enlarged scale, partially in section.
Figure 21:
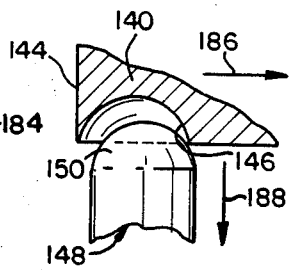

In order to fully understand the sequential operation which is illustrated in FIGS. 11–14, it is first necessary to understand the nature and operation of the camming action between the ends 144 of the blade 140 and the swivel catches 148, which is illustrated in FIGS. 20 and 21. In FIG. 20, an upper portion of one end of blade 140 and the smaller portion 154 of a swivel catch 156 are shown in greatly enlarged scale. Due to the rotation of the blade and ring, there is a certain compound or vector aspect of the movement between the blade and the ring, which can be ignored for purposes of this explanation. As the end of the blade 144 moves in the direction of arrow 180, the squared or right angular tip 182 of the end of the blade 144 can engage or push against the hemispherical portion 154 of a swivel catch 148, and in so doing, will force the swivel catch in the direction of arrow 184. This movement may be upwardly as illustrated, that is, against the force of gravity. In FIG. 21, the swivel catch and blade have been fully engaged with one another, as shown in FIG. 19, and the blade has begun to move away from the swivel catch, and the ring, in the direction of arrow 186. The camming action between the inner surface of the detent 146 and the hemispherical portion 154 drives the swivel catch in the direction of arrow 188. In terms of pump operation, both camming movements force the swivel catch away from the ring, into the slot 126. One of the ramps 170, depending upon the direction of rotation, provides a camming force in the opposite direction, enabling the swivel catches to move into engagement with the blade. The camming action provides for positive displacement of the swivel catches into and out of engagement with the blade irrespective of the orientation of the pump, and irrespective of the operation of gravitational force.

Figure 11:
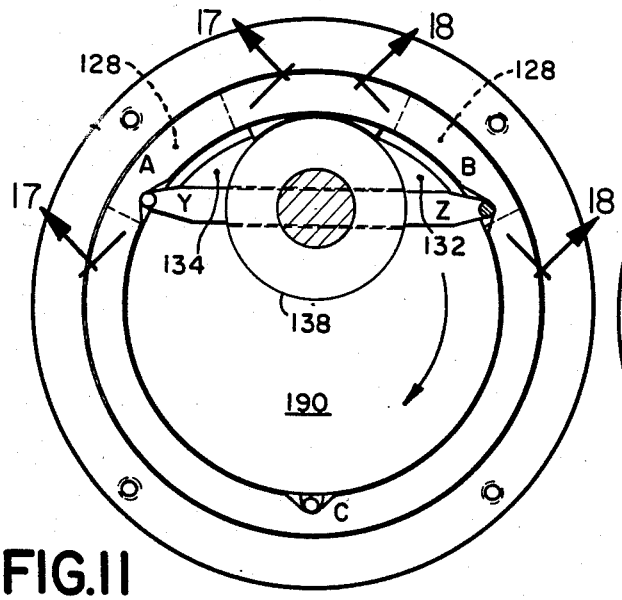
FIGS. 11–14 are plan views, partially in section and partially diagrammatic in nature, sequentially illustrating the operational geometry of the rotary fluid pump shown in FIG. 10.
Figure 12:
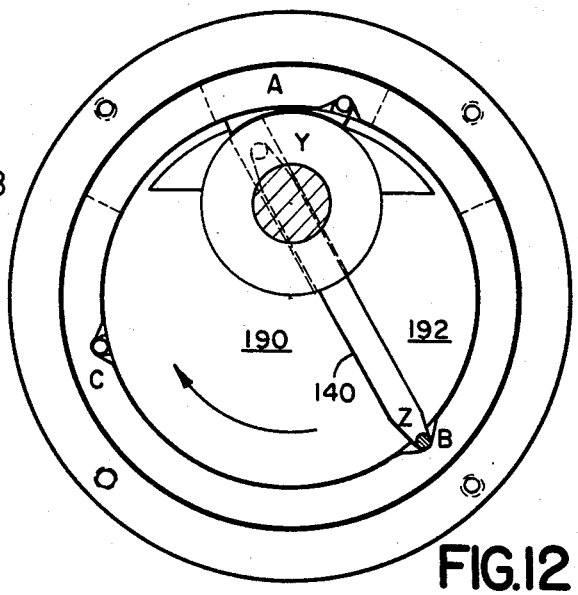
Figure 13:
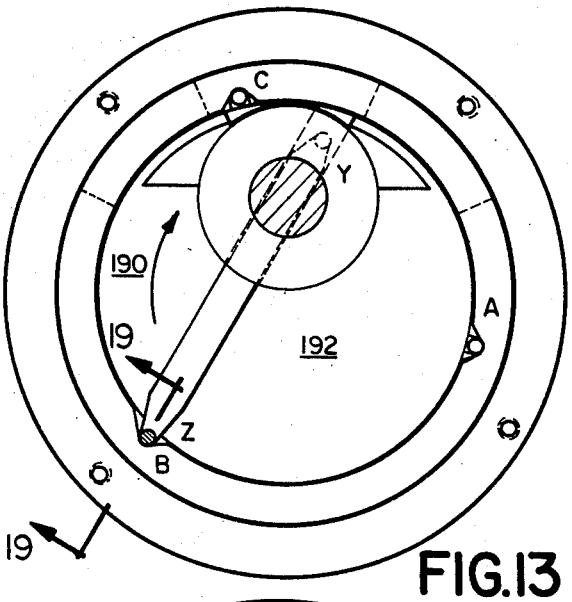
Figure 14:
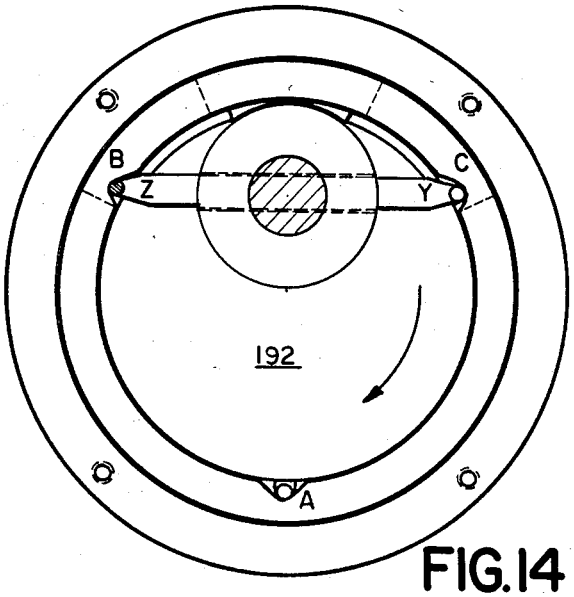

Sequential operation is illustrated in FIGS. 11–14. In order to clarify the description, the slots of the ring have been labeled A, B and C. Opposite ends of the blade have been labeled Y, Z. In the position of FIG. 11, assuming the midst of operation, virtually the entire pumping chamber defines a pumping section 190. The blade is substantially centered within the slot of the driving hub. It can be appreciated that the blade is not as long as the inner diameter of the pumping chamber. In the position of FIG. 11, end Y of the blade is moving out of engagement with the swivel catches associated with slot A. At the same time, the end Z of the blade is moving into engagement with the swivel catches associated with slot B. As the driving hub and the blade rotate clockwise into the position of FIG. 12, the fluid in pumping chamber section 190 is forced out of outlet 134 and fluid is drawn into pumping chamber section 192 through inlet 132. End Y of the blade has moved completely out of slot A and is disposed inside the driving hub. The end Z of the blade remains locked in engagement with the swivel catches of slot B. The hub rotatably drives the blade, which in turn rotatably drives the ring. In the position of FIG. 13, pumping chamber section 190 is nearly empty and pumping section 192 is approaching its full size. The full engagement of the swivel catches with the end of the ring is illustrated in FIG. 19. Further rotation into the position of FIG. 14 completely empties pumping chamber 190 and completely fills pumping chamber 192. In the position of FIG. 14 the end Z of the blade is moving out of engagement with the swivel catches of slot B. At the same time, the end Y of the blade is moving into engagement with the swivel catches associated with slot C.

Figure 16:
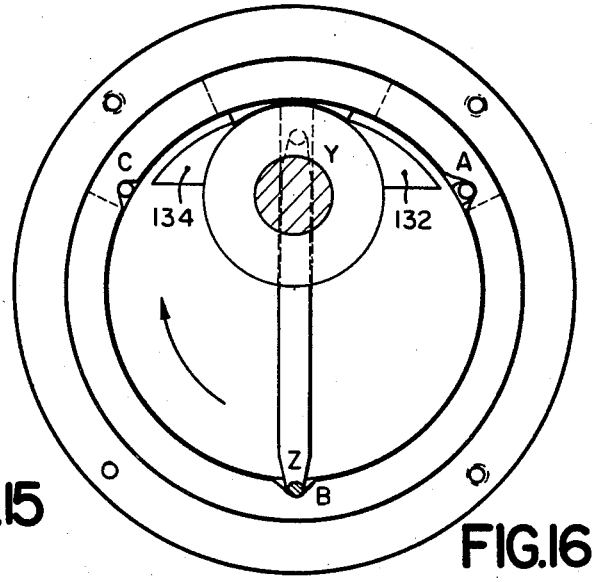
FIG. 16 is a plan view, partially in section and partially diagrammatic in nature, occurring between FIGS. 12 and 13 in sequence.

Further rotation of the pump will result again in the orientation of FIG. 12, except that end Y of the blade will be positively engaged in slot C in positions corresponding to FIGS. 12 and 13. Assuming an arbitrary starting point, the pump will exhibit the following sequence of operation, insofar as sequential engagement of slots and blade ends is concerned, only one end of the blade being positively engaged with the ring at a time: AY, BZ, CY, AZ, BY, CZ, and the sequence repeats. It will be appreciated that the distance between the center of the driving hub and each of the engaged slots differs over the rotation of the blade. Accordingly, the ring is rotated at different speeds over the course of rotation of the blade. The differences in rotation between the driving hub and the ring are accommodated by the sliding movement of the blade in the slot of the driving hub, by the pivotal movement of the blade about its engaged end, in slot 164 and by the engagement and disengagement of the swivel catches. The rotation of the ring is at a maximum in the position of FIG. 16, which is sequentially between that of FIGS. 12 and 13. In this position the length of the blade extending beyond the driving hub is at a maximum, as is the length of the empty portion of slot 142. The extended length of the blade is at a minimum in the position of FIG. 11, and slot 142 is filled.

Figure 15:
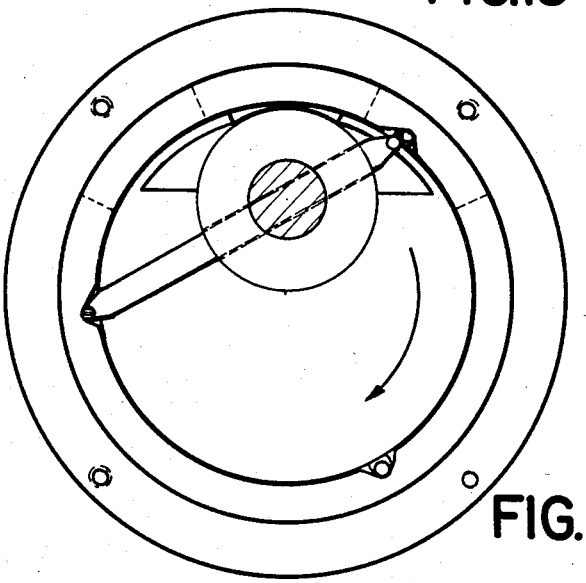
FIG. 15 is a plan view, partially in section and partially diagrammatic in nature, occurring shortly before FIG. 11 in sequence.

With reference again to FIGS. 11, 17 and 18, assume that end Y is in engagement with the swivel catches of slot A, as otherwise illustrated in FIG. 19. As the end Y of the blade is pulled away from the ring by further rotation, toward the position of FIG. 12, the camming action illustrated in FIG. 21 will drive the upper and lower swivel catches upwardly and downwardly respectively, into slot 128. By the time the swivel catch is driven to the portion 172, the blade will be fully disengaged from slot A. At the same time, in a position similar to that of FIG. 15, a camming action as shown in FIG. 20 will drive upper and lower disengaged swivel catches upwardly and downwardly respectively, into the other slot 128. Further rotation of the swivel catch by means of the ring will force the upper and lower swivel catches on to ramp portions 170, driving them downwardly and upwardly respectively into engaged positions in the indent or detent 146. The engagement and disengagement taking place in the position of FIG. 11 occurs simultaneously. Preferably, there is a certain overlap of several degrees built into the dimensions of the catch, slot and other structure to prevent binding at this position.

Rotary pump 100 is self priming, as rotary pump 10, and each is fully capable of operation in any orientation irrespective of gravity. The camming actions provide positive engagement and disengagement of the swivel catches. The rotary pump 100 requires only one rotating ring, as compared to the first embodiment, but does require careful calibration and machining in terms of assuring smooth engagement and disengagement of the swivel catches.

The materials from which these pumps may be manufactured will vary to some extent with regard to the working environment, the fluid pumping requirements and the fluid to be pumped. In most instances, the pump will be made from metal, for example steel or other suitable metal alloys. In view of the extent to which metal surfaces slidably engage one another, such metals and/or alloys must be chosen with a view toward minimizing sliding friction. The extent to which all or portions of the components will be treated, hardened or otherwise prepared will depend upon the economics of the particular installation. The sliding seals can be made from any number of suitable resilient elastomeric materials. In any event, such seals are easy and relatively inexpensive to replace, when replacement becomes necessary.

Each embodiment provides a positive displacement rotary force fluid pump with the largest possible pumping chamber for a given pump housing. Each embodiment provides enhanced pumping capacity with smoother action and enhanced reliability. Each embodiment utilizes structure which facilitates fluid-sealing of the pump and prolongs the operational life of the seals. The special use of rotating rings makes for a more efficient pump, even though such structure might otherwise seem at first to be more a hindrance and complication.

This invention may be embodied in other specific forms without departing from the spirit or essential attributes thereof. Accordingly, reference should be made to the appended claims, rather than the foregoing specification, as indicating the scope of the invention.

What is claimed is:

1. A rotary force fluid pump, comprising:

a housing defining a circular cylindrical pumping chamber;

a blade means disposed in the pumping chamber;

a blade means positioning ring mounted for rotation around the periphery of the pumping chamber;

eccentrically disposed drive means for slidably engaging and rotating the blade means and the pumping chamber;

means effecting sequential engagement and disengagement of the blade means to preselected positions on the ring during rotation, which together with the sliding movement between the blade means and the drive means, changes the effective length of the blade in the pumping chamber during the eccentric rotation;

means for admitting fluid into the pumping chamber; and, means for exhausting fluid from the pumping chamber.

2. A pump according to claim 1, wherein the blade means comprises a substantially rigid non-extensible blade member.

3. A pump according to claim 1, wherein the means effecting sequential engagement and disengagement of the blade means comprises:

the blade positioning ring having three equiangularly spaced grooves on the inner surface thereof for sequentially receiving opposite ends of the blade means;

the housing having slots defining raceways in which the blade positioning ring rotates during operation, the raceways having two deeper slots formed therein;

a plurality of swivel catch members, one mounted at each end of each slot in the blade positioning ring and adapted to ride in one of the raceways; and, the blade means having tapered ends with substantially hemispherical detents formed at each lateral end thereof for releasably engaging the swivel catches of respective slots.

4. A pump according to claim 3, wherein the blade means comprises a substantially rigid non-extensible blade member.

5. A pump according to claim 3, wherein each swivel catch comprises a first substantially hemispherical portion of a first diameter, adapted to engage the raceway, a substantially circular cylindrical portion of a second diameter, smaller than the first diameter and having a longitudinal axis offset from the center of the first diameter, and a second substantially hemispherical portion of the second diameter and adapted to engage in the substantially hemispherical detents of the blade means.

6. A pump according to claim 5, wherein the blade means comprises a substantially rigid non-extensible blade member.

7. A rotary force fluid pump, comprising:

a housing defining a circular cylindrical pumping chamber;

a stacked pair of blade positioning rings mounted for independent rotation around the periphery of the pumping chamber;

a blade assembly pivotally mounted at each end to a different one of the rings and dividing the pumping chamber into two sections which vary in volume as the blade assembly rotates;

eccentrically disposed drive means for slidably engaging and rotating the blade assembly in the pumping chamber, the blade in turn rotatably driving the rings at different speeds relative to one another, causing the pivotally mounted ends of the blade assembly to move toward and away from one another during rotation;

means in the blade assembly for accomodating the relative movement of the ends of the blade assembly during the eccentric rotation;

means for admitting fluid into the chamber; and, means for exhausting fluid from the chamber.

8. A pump according to claim 7, wherein the blade assembly comprises two rigid parts with slidably interfitting structure.

9. A pump according to claim 7, wherein the blade assembly has opposite working surfaces disposed in planes parallel to the axes of the positioning rings.

10. A pump according to claim 7, wherein the axes of the rings and the drive means are parallel.

11. A pump according to claim 7, wherein each pivotal mounting comprises a bore through the ring, an inwardly opening, expanding recess in a plane perpendicular to the bore, a flange extending outwardly from the blade assembly having an opening and a pivot pin disposed through the bore and opening, whereby the flange is free to rotatably slide in the recess about the pivot pin during rotation of the blade assembly.

12. A pump according to claim 7, wherein the blade assembly comprises two rigid parts with slidably interfitting structure, having opposite working surfaces disposed in planes parallel to the axes of the positioning rings; and, further comprising resilient sealing means carried by the blade assembly, disposed between the inner surfaces of the positioning rings and corresponding inner surface facing structure of the blade assembly and having outwardly directed sealing surfaces for slidably engaging the inner surfaces of the positioning rings.

13. A pump according to claim 7, further comprising resilient sealing means disposed between the inner surfaces of the positioning rings and corresponding inner surface facing structure of the blade assembly.

14. A pump according to claim 13, wherein the sealing means are slidably carried by the blade assembly and have outwardly directed sealing surfaces for slidably engaging the inner surfaces of the positioning rings.

* * * * *